US010683129B2

(12) United States Patent
Tuszkiewicz et al.

(10) Patent No.: US 10,683,129 B2
(45) Date of Patent: Jun. 16, 2020

(54) PAPERBOARD CARTON

(71) Applicant: General Mills, Inc., Minneapolis, MN (US)

(72) Inventors: George A Tuszkiewicz, Plymouth, MN (US); Peter L Novotny, Brooklyn Park, MN (US); Jenna M Ronquillo, Woodbury, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 16/073,151

(22) PCT Filed: Feb. 17, 2016

(86) PCT No.: PCT/US2016/018250
§ 371 (c)(1),
(2) Date: Jul. 26, 2018

(87) PCT Pub. No.: WO2017/142528
PCT Pub. Date: Aug. 24, 2017

(65) Prior Publication Data

US 2019/0039778 A1 Feb. 7, 2019

(51) Int. Cl.
*B65D 5/44* (2006.01)
*B65D 5/10* (2006.01)
(Continued)

(52) U.S. Cl.
CPC ..... *B65D 5/445* (2013.01); *B65B 1/02* (2013.01); *B65B 11/585* (2013.01); *B65D 5/00* (2013.01);
(Continued)

(58) Field of Classification Search
CPC ..... B65D 5/323; B65D 5/0015; B65D 5/324; B65D 2301/10
(Continued)

(56) References Cited

U.S. PATENT DOCUMENTS 269,170 A 12/1882 Bragdon
380,364 A 4/1888 Scales
(Continued)

FOREIGN PATENT DOCUMENTS

FR 2609965 7/1988
WO WO 1994/012328 6/1994
(Continued)

OTHER PUBLICATIONS

The Gold Jellybean, "*Repurposed Cereal Boxes for Desk Organization*", Blog Article, retrieved on Apr. 2, 2016 from the internet: <URL:http://thegoldjellybean.com/2012/05/repurposed-creal-boxes-for-deks-organization.html>.
(Continued)

*Primary Examiner* — Christopher R Demeree
(74) *Attorney, Agent, or Firm* — Diederiks & Whitelaw, PLC; Gregory P. Kaihoi, Esq.

(57) ABSTRACT

A carton is formed from folding a unitary blank, made from paperboard, to establish a front panel, a rear panel, opposing side panels, a bottom wall and a top wall. To strengthen the carton, at least two side inserts, having a caliper which is equal to or greater than the caliper of the unitary blank, are provided within an interior cavity of the carton and against a respective one of the opposing side panels. The unitary blank has a predominate fiber orientation which is directionally different from each of the at least two side inserts. With this arrangement, the cartons have enhanced structural integrity, enabling similarly configured cartons to be effectively, vertically stacked without deformation.

21 Claims, 7 Drawing Sheets

(51) Int. Cl.

| | |
|---|---|
| ***B65D 19/00*** | (2006.01) |
| ***B65D 71/00*** | (2006.01) |
| ***B65B 1/02*** | (2006.01) |
| ***B65B 11/58*** | (2006.01) |
| ***B65D 5/00*** | (2006.01) |

(52) U.S. Cl.
CPC ..... *B65D 5/106* (2013.01); *B65D 19/0004* (2013.01); *B65D 71/0088* (2013.01)

(58) Field of Classification Search
USPC ..... 229/120, 122.24, 919, 122.21, 122.32; 493/84, 906
See application file for complete search history.

(56) References Cited

U.S. PATENT DOCUMENTS

| | | | | | |
|---|---|---|---|---|---|
| 674,009 | A | * | 5/1901 | Lewis | B65D 5/566 229/122.33 |
| 1,265,273 | A | | 5/1918 | Stokes et al. | |
| 1,512,157 | A | | 10/1924 | Bliss | |
| 1,514,367 | A | | 11/1924 | Bliss | |
| 1,895,778 | A | | 1/1933 | Andrews | |
| 2,149,955 | A | | 3/1939 | Burns | |
| 2,362,862 | A | * | 11/1944 | Sidebotham | B65D 5/067 229/249 |
| 2,374,390 | A | | 4/1945 | Snyder | |
| 2,475,441 | A | * | 7/1949 | Abbott | A45C 1/12 206/0.815 |
| 2,593,778 | A | * | 4/1952 | McGinnis | B65D 5/742 229/248 |
| 2,606,709 | A | | 8/1952 | Carey et al. | |
| 2,609,138 | A | | 9/1952 | Weiss | |
| 2,701,679 | A | * | 2/1955 | Goldstein | B65D 5/744 229/215 |
| 2,947,414 | A | | 8/1960 | Johnson | |
| 3,007,622 | A | | 11/1961 | George | |
| 3,099,379 | A | * | 7/1963 | Stease | B65D 5/448 229/122.26 |
| 3,217,924 | A | | 11/1965 | Chidsey, Jr. | |
| 3,237,838 | A | | 3/1966 | Elias | |
| 3,291,370 | A | | 12/1966 | Elias | |
| 3,788,538 | A | | 1/1974 | Kuenzi | |
| 3,993,239 | A | | 11/1976 | Exel | |
| 4,040,559 | A | | 8/1977 | Giebel | |
| 4,211,358 | A | | 7/1980 | Crane | |
| 4,620,479 | A | | 11/1986 | Diamond et al. | |
| 4,655,386 | A | | 4/1987 | Billberg | |
| 4,871,063 | A | | 10/1989 | Kumbier | |
| 4,884,739 | A | | 12/1989 | Nederveld | |
| 5,201,461 | A | | 4/1993 | Sykora | |
| 5,316,207 | A | | 5/1994 | Ross et al. | |
| 5,333,779 | A | | 8/1994 | Sykora et al. | |
| 5,390,847 | A | | 2/1995 | Young | |
| 5,419,485 | A | | 5/1995 | Petriekis et al. | |
| 5,497,939 | A | | 3/1996 | Heiskell et al. | |
| 5,639,015 | A | | 6/1997 | Petriekis et al. | |
| 5,839,650 | A | | 11/1998 | Sheffer | |
| 6,050,484 | A | | 4/2000 | Galomb | |
| 6,062,467 | A | | 5/2000 | Ours et al. | |
| 6,138,904 | A | | 10/2000 | Baird et al. | |
| 6,168,074 | B1 | | 1/2001 | Petriekis et al. | |
| 6,186,393 | B1 | | 2/2001 | Tsamourgelis | |
| 6,712,214 | B1 | | 3/2004 | Wintermute et al. | |
| 7,070,054 | B2 | | 7/2006 | Scrymgeour et al. | |
| 7,074,171 | B2 | | 7/2006 | Mahlum et al. | |
| 8,196,806 | B2 | * | 6/2012 | Tao | B65D 5/324 229/122.26 |
| 8,695,870 | B2 | | 4/2014 | Etzel et al. | |
| 8,763,890 | B2 | | 7/2014 | Clark et al. | |
| 8,777,097 | B2 | | 7/2014 | Jacomelli et al. | |
| 8,875,983 | B2 | | 11/2014 | Lenhard et al. | |
| 2001/0048022 | A1 | | 12/2001 | Zoeckler | |
| 2003/0038169 | A1 | | 2/2003 | Thibault | |
| 2006/0113364 | A1 | | 6/2006 | Bonner et al. | |
| 2007/0152029 | A1 | | 7/2007 | Gardner | |
| 2012/0261463 | A1 | | 10/2012 | Scott | |
| 2013/0020383 | A1 | | 1/2013 | Tautz et al. | |
| 2014/0013716 | A1 | | 1/2014 | Mallard | |

FOREIGN PATENT DOCUMENTS

| | | |
|---|---|---|
| WO | WO 2015/116049 | 8/2015 |
| WO | WO 2017/018988 | 2/2017 |

OTHER PUBLICATIONS

Urbanik, "*Machine Direction Strength Theory of Corrugated Fiberboard*", Journal of Composites Technology & Research, JCTRER, vol. 18, No. 2, Apr. 1996, pp. 80-88.
Grain Direction, The Paper Mill Store, Oct. 11, 2013.

* cited by examiner

PAPERBOARD CARTON

CROSS REFERENCE TO RELATED APPLICATIONS

This application represents a National Stage application of PCT/US2016/018250 filed Feb. 17, 2016 and titled "Paperboard Carton". The entire content of this application is incorporated by reference.

FIELD OF THE INVENTION

The invention generally pertains to packaging products, particular food products, in cartons and, more specifically, to a paperboard carton made from a single blank and separate side inserts for increased structural integrity.

BACKGROUND OF THE INVENTION

In connection with shipping various types of products, such as food products, from a manufacturer to a retail establishment, it is known to initially package the products in cartons. Although various materials could be used in making the cartons, the most common material employed is paperboard. In general, the paperboard is provided in the form of a blank which can be conveniently stored in a flat configuration or side seamed configuration but easily erected through a simple folding operation to establish an open-ended carton which can be filled and sealed, typically in an automated process. Multiple cartons are then typically arranged side-by-side in a corrugated box for shipping through designated distribution channels to the retail establishment, such as a grocery store, where the cartons in each shipping box can be unloaded and arranged on a display shelf for sale to consumers.

Known end load cartons of this type are not only lightweight, but the paperboard is advantageously recyclable. However, such paperboard cartons lack significant compression strength, leading to the need for the cartons to be loaded side-by-side in the protective, outer corrugated shipping boxes. If additional strength is needed for shipping purposes, common sense would dictate strengthening a single corrugated box which can hold numerous paperboard cartons rather than incurring the added expense of reinforcing each paperboard carton. With this in mind, certain advancements have been made in the area of corrugated boxes to enable numerous loaded boxes to be stacked on one another, while avoiding crushing of the boxes and stacking forces from being borne by the cartons. For example, enhanced lamination configurations, fluting techniques and material variations represent certain approaches commonly considered in the industry.

Another possibility would be to form the carton from a blank having a higher caliper, thereby increasing the basis weight and strength. With either of these potential design changes, the goal of strengthening a food product carton is certainly achievable. Unfortunately, neither of these scenarios is considered practical, particularly as the added cost of bolstering the strength of the cartons, taking into account the sheer volume of such paperboard cartons used in the food industry alone, would be prohibitive. With this in mind, it would really only be advantageous to package food products directly in paperboard cartons if the cartons themselves could be strengthened, such as to enable vertical stacking of the cartons without damage, without increasing the amount of fiber material employed so as to avoid increasing the fiber material costs. Even further, it would be unprecedented if the paperboard cartons could even be shipped in a stacked configuration without the need for an outer container, such as a corrugated box. Still, in light of the known drawbacks, it would be desirable to provide paperboard cartons which are stronger so as to enhance their ability to be stacked if the same could be economically accomplished.

SUMMARY OF THE INVENTION

The invention is directed to forming a paperboard carton from a single, unitary blank in combination with side inserts. The side inserts are formed of at least the same caliper material as the blank while increasing the structural integrity of the carton, such that the carton exhibits a compression strength which enables similarly configured cartons to be directly stacked upon each other for shipping purposes. In other embodiments, the blank differs from the side inserts in construction, particularly with respect to a caliper and/or a fiber orientation, to further enhance the overall structural integrity.

More specifically, a carton constructed in accordance with the invention is formed from a unitary blank made from a paperboard material having a specified caliper or basis weight. The unitary blank is folded to establish a front panel, a rear panel, opposing side panels, a bottom wall and a top wall. To strengthen the carton, at least two side inserts, having a caliper which is equal to or greater than the caliper of the unitary blank, are provided within an interior cavity of the carton and against the opposing side walls. The unitary blank has a predominate fiber orientation which is directionally different from each of the at least two side inserts. With this arrangement, the carton exhibits a compression strength which enables similarly configured ones of the cartons to be directly stacked for shipping purposes.

Additional objects, features and advantages of the invention will become more readily apparent from the following detailed description when taken in conjunction with the drawings wherein like reference numerals refer to corresponding parts in the several views.

DETAILED DESCRIPTION OF THE INVENTION

Figure 1:
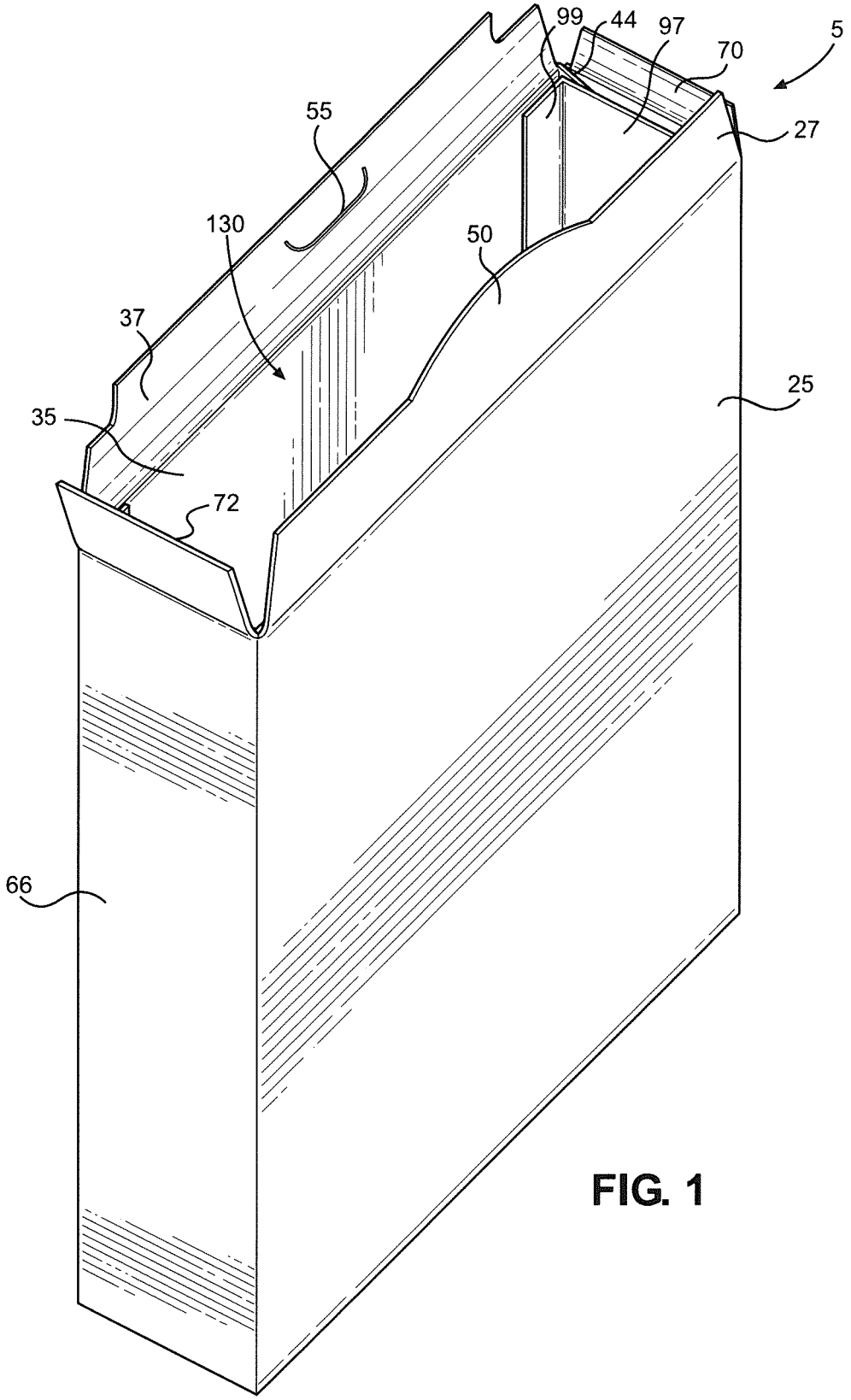
FIG. 1 is a perspective view of an upper portion of an open ended paperboard carton constructed in accordance with an embodiment of the invention.

Detailed embodiments of the present invention are disclosed herein. In connection with this description, it should be noted that the use of certain terms, such as inside, outside, front, rear, top, bottom and the like, herein is for reference purposes only in describing exemplary forms of the invention as set forth below and illustrated in the drawings. Therefore, these terms should not be considered limiting as to the overall invention. Instead, it is to be understood that the disclosed embodiments are merely exemplary of the invention that may be embodied in various and alternative forms. The figures are not necessarily to scale, and some features may be exaggerated or minimized to show details of particular features or components.

In general, described below is the construction of cartons, such as food cartons formed from paperboard, in accordance with the invention. It will be recognized that each embodiment is concerned with establishing a carton from a single, unitary blank in combination with side inserts. In accordance with another aspect of the invention, the blank differs from the side inserts in construction, particularly with respect to a caliper and/or a fiber orientation. The overall construction provides added strength to the cartons, enabling similarly configured ones of the cartons to be directly stacked for shipping purposes.

With initial reference to FIGS. 1-4, an open ended carton constructed in accordance with the present invention is generally indicated at 5. In accordance with this preferred embodiment, carton 5 is formed from a folded, unitary blank 15 to which first and second side inserts 19 and 21 are added. More specifically, blank 15 includes a first main side or front panel 25, an upper flap 27 and a lower flap 28, with upper and lower flaps 27 and 28 being joined to front panel 25 along fold lines 30 and 31 respectively. In addition, blank 15 includes a second main side or rear panel 35, an upper flap 37 and a lower flap 38, with upper and lower flaps 37 and 38 being joined to rear panel 35 along fold lines 40 and 41 respectively. Also attached to rear panel 35 along a fold line 42 is an elongated leg 44. Overall, each of front and back panels 25 and 35 are shown to be substantially rectangular in shape with mitre or angled cuts for the upper and lower flaps 27 and 37, 28 and 38, although the exemplified shape is not limiting to the invention. As also depicted, upper flap 27 is formed with a central tab 50 and a central slot 55 is provided in upper flap 37. Blank 15 further includes side panels 65 and 66, each of which includes upper and lower flaps 70, 71 and 72, 73, along with associated fold lines 76, 77 and 78, 79 respectively. As depicted, side panel 65 is provided at an end of blank 15 and is connected to front panel 25 along a fold line 81, while side panel 66 is intermediate front panel 25 and rear panel 35 with associated fold lines 82 and 83 there between.

Figure 2:
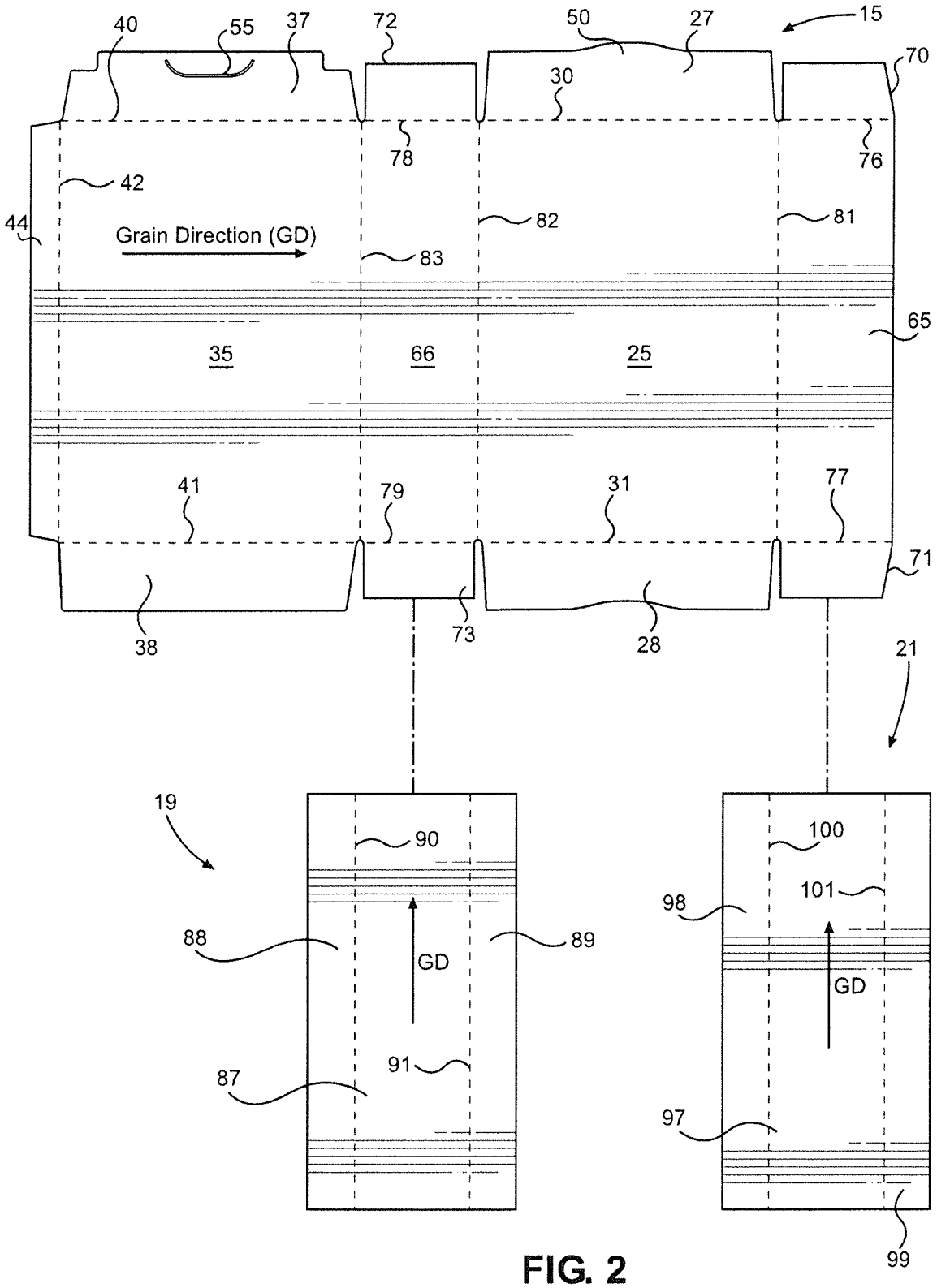
FIG. 2 is a view of a blank assembly from which the carton of FIG. 1 is erected.
Figure 3:
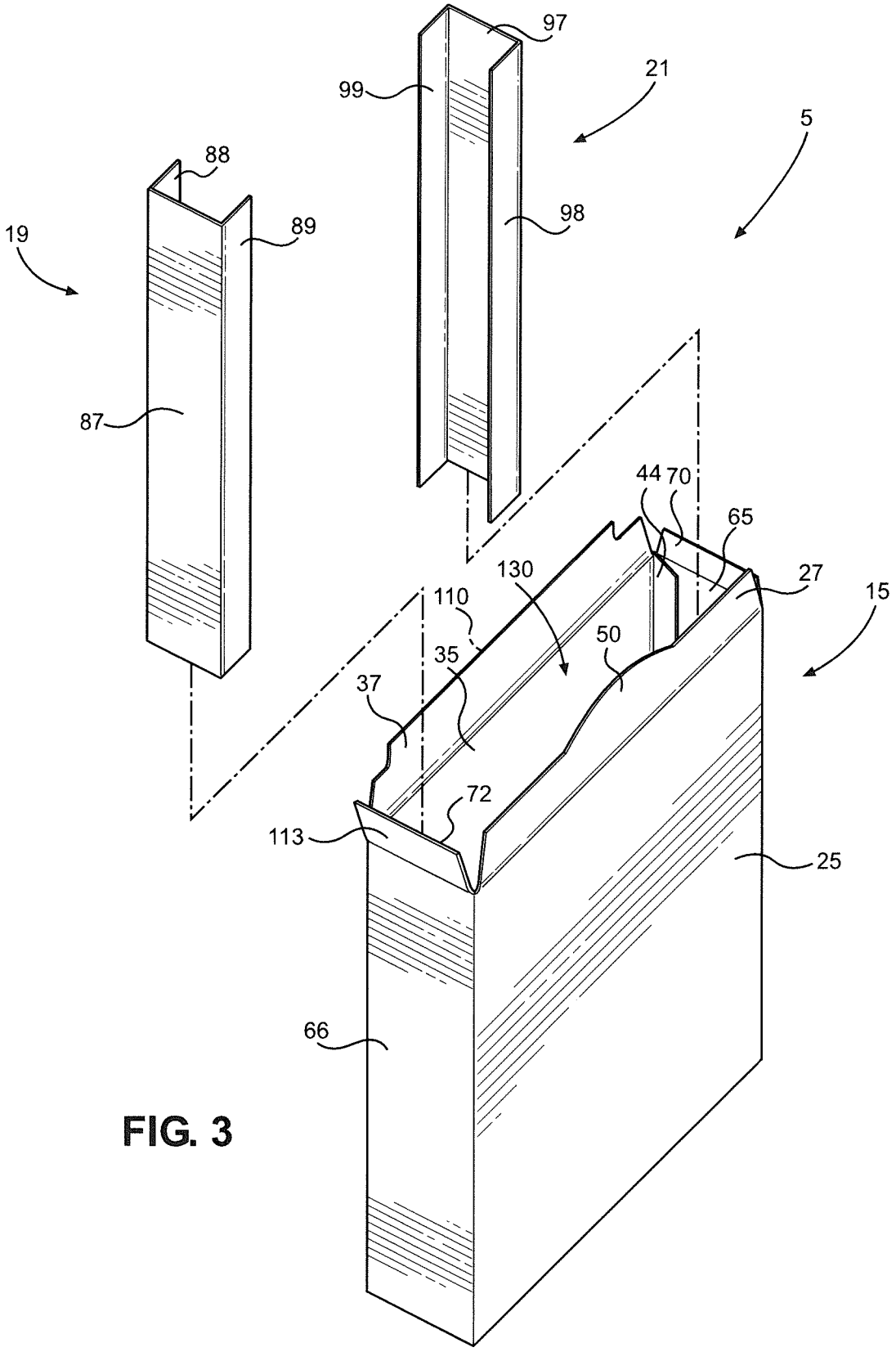
FIG. 3 is an exploded view of the carton of FIG. 1.

As perhaps shown best in FIGS. 2 and 3, first side insert 19 includes a side wall 87 from which extend, at spaced locations, elongated legs 88 and 89 along fold lines 90 and 91 respectively. In the embodiment shown, second side insert 21 is symmetrically constructed to first side insert 19 and therefore includes a side wall 97, elongated legs 98 and 99, and associated fold lines 100 and 101.

Figure 4:
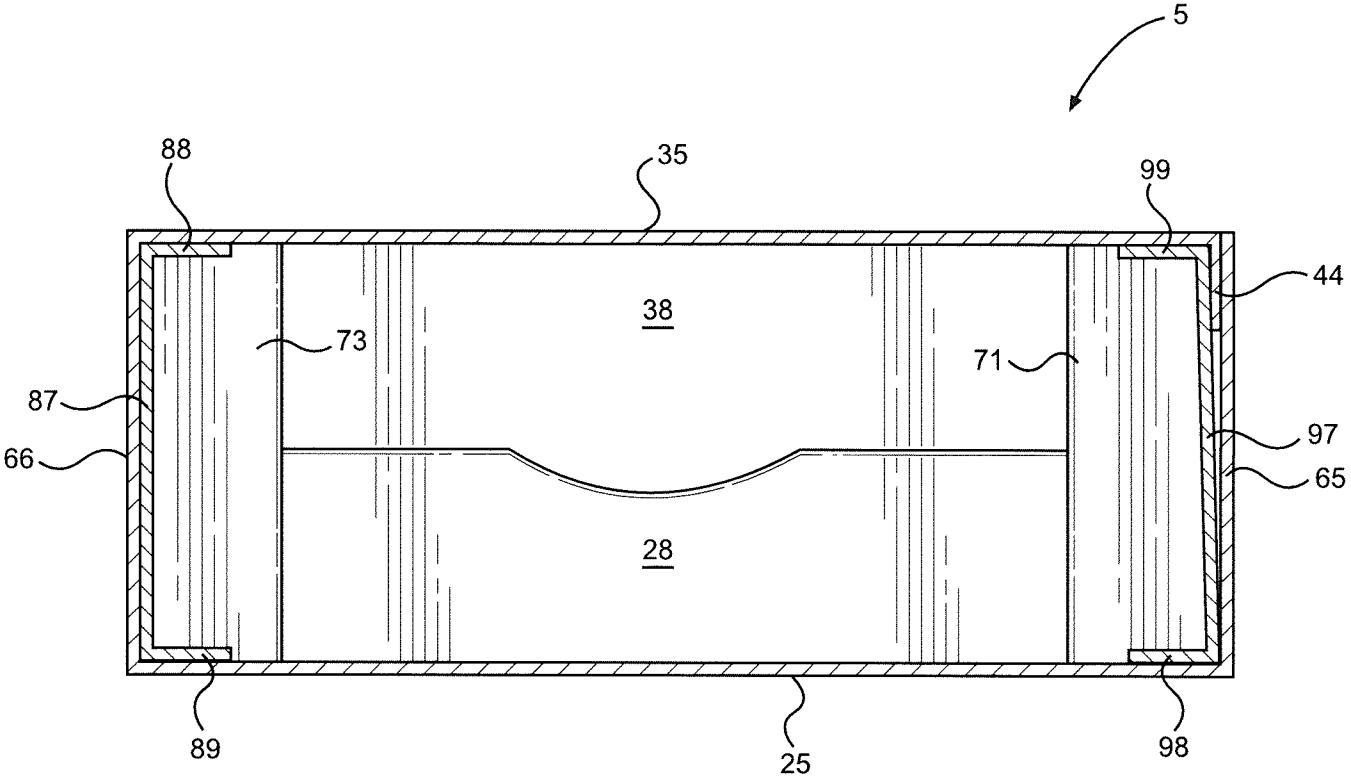
FIG. 4 is top cross-sectional view of the carton of FIG. 1.

In assembling or erecting carton 5 to the condition presented in FIGS. 1 and 4, blank 15 of FIG. 2 is folding along fold lines 81-83, with front and rear panels 25 and 35 becoming spaced by side panels 65 and 66. At the same time, elongated leg 44 is folded along fold line 42 and is secured to side panel 65. In a preferred form, adhesive is used for this purpose, such a pre-applying an adhesive along elongated leg 44. Either before or after one of a top or bottom of carton 5 is sealed, side inserts 19 and 21 are introduced into internal cavity 130. More specifically, legs 88, 89, 98 and 99 are folded along respective fold lines 90, 91, 100 and 101 such that the side inserts 19 and 21 assume the condition shown in FIG. 3 and then the side inserts 19 and 21 are inserted into carton 5 against side panels 65 and 66. In particular, side walls 87 and 97 are positioned along side panels 66 and 65 respectively, while elongated legs 89 and 98 are positioned directly along front panel 25 and legs 88 and 99 extend directly along rear panel 35. In a preferred form, side inserts 19 and 21 are secured within an internal cavity 130 (see FIGS. 1 and 3) defined within carton 5, such as through the use of adhesive provided along elongated legs 88, 89, 98 and 99, either alone or even in combination with side walls 87 and 97.

At this point it should be recognized that the bottom of carton 5 is sealed by folding flaps 71 and 73 inward along fold lines 77 and 79, folding flap 28 along fold line 31 and then folding flap 38 along fold line 41. Adhesive, such as on flaps 71, 73 and a portion of flap 38 which overlaps with flap 28, is preferably used to seal the bottom of carton 5. After filling internal cavity 130, such as with a liner bag containing food pieces (not shown), the top of carton 5 can be sealed by folding flaps 70 and 72 inward along fold lines 76 and 78, folding flap 37 along fold line 40, and then folding flap 27 along fold line 30. Again, adhesive can be used to secured these portions together, such as providing adhesive on flaps 70 and 72, as well as a long an overlapping portion of one or more of flaps 27 and 37.

In this embodiment shown, front and rear panels 25 and 35 are the largest of the side walls of carton 5 in area, i.e., each panel 25, 35 establishes a face for carton 5 having an associated area which is generally in the order of at least three times the surface area of either of opposing side panels 65 and 66. For the particular type of carton shown, each of the side panels 65, 66 is also greater in area than a bottom wall established essentially by overlapping lower flaps 28 and 38. By way of example, panel 25 can constitute the face of a cereal or other carton and can be provided with suitable indicia reflecting the name, brand and the like of product contained within interior cavity 130 of carton 5 for sale to a consumer, such as edible cereal food products. Like a conventional food carton which is formed by folding a single blank, the top of carton 5 can be selectively closed, after being initially opened, by slipping tab 50 of upper flap 27 in a slot 55 provided in lower flap 37.

As indicated above, it is an object of the invention to increase the structural integrity of carton 5, particularly so that carton 5 is able to withstand significant vertical loading without being crushed or buckling, even enabling multiple cartons 5 to be vertically stacked and have exerted thereon certain vertical loads without deformation, particularly when shipped. Initially, it should be recognized that the vertical load capability of carton 5 is enhanced to a significant degree in accordance with the invention as compared to a conventional carton based on the inclusion of side inserts 19 and 21 which importantly extend into the vertical corners of carton 5. By way of example, below is presented Table 1 with top-to-bottom compression force data of cereal boxes with side inserts constructed in accordance with the invention in relation to a standard 64 cubic inch cereal box made from 16 pt recycled fiber paperboard.

TABLE 1

| | T-B Comp (lbsf) |
|---|---|
| Control Carton | 34.2 |
| Side Inserts (glued w/¾ inch wide legs) | 85.8 |
| Side Inserts (unglued w/¾ inch wide legs) | 60.2 |

With the above in mind, the multi-piece construction of carton 5 certainly contributes to the goals of the invention. However, in further accordance with the invention, other structural parameters can also be altered to further enhance the objects of the invention. In particular, the basis weight or caliper of the paperboard material of side inserts 19 and 21 can be made greater than the caliper of blank 15. This aspect of the invention can be achieved by reducing the basis weight of blank 15, increasing the basis weight of side inserts 19 and 21, or both. In accordance with another aspect of the invention, the fiber orientation of each of side inserts 19 and 21 is different than blank 15. Most preferably, the paperboard fibers of front panel 25, rear panel 35 and side panels 65 and 66 are arranged to more predominantly run horizontally, while the fibers of side inserts 19 and 21, including each of side walls 87 and 97, as well as elongated legs 88, 89, 98 and 99, mainly run vertically (see Grain Direction or GD indications in FIG. 2). Obviously, paperboard will generally have mixed fiber orientations. However, in accordance with this aspect of the invention, the overall majority of the fiber orientation is controlled. For instance, for side inserts 19 and 21, a 5:2 ratio of vertical to horizontal fibers, i.e., predominantly vertical versus predominantly horizontal, can be employed such that at least 70% of the fibers are mainly orientated in the desired direction. In accordance with a still further aspect of the invention, although the entire carton 5 can be formed of paperboard, mixed types of materials can be employed, such as non-recycled material for side inserts 19 and 21 versus recycled materials for blank 15, or even other material compositions for side inserts 19 and 21, like flexible or rigid plastic. Overall, the top-to-bottom and side-to-side compression strength can be enhanced by increasing the amount of basis weight of fiber in the areas of the greatest mechanical stresses. Depending on the required compression strength, even the shape of the elongated legs 88, 89, 98 and 99 can be important. That is, as best shown in FIG. 2, side inserts 19 and 21 are rectangular in shape, with elongated legs 88, 89, 98 and 99 having straight cut legs. Although mitre cuts corresponding to those shown used for flaps 27, 28, 37 and 38 could also be employed for the upper and lower portions of elongated legs 88, 89, 98 and 99, this seemingly minor change resulted in an overall compression loss in the order of 38% as compared to straight cut or substantially ninety degree (90°) cornered legs.

Figure 5:
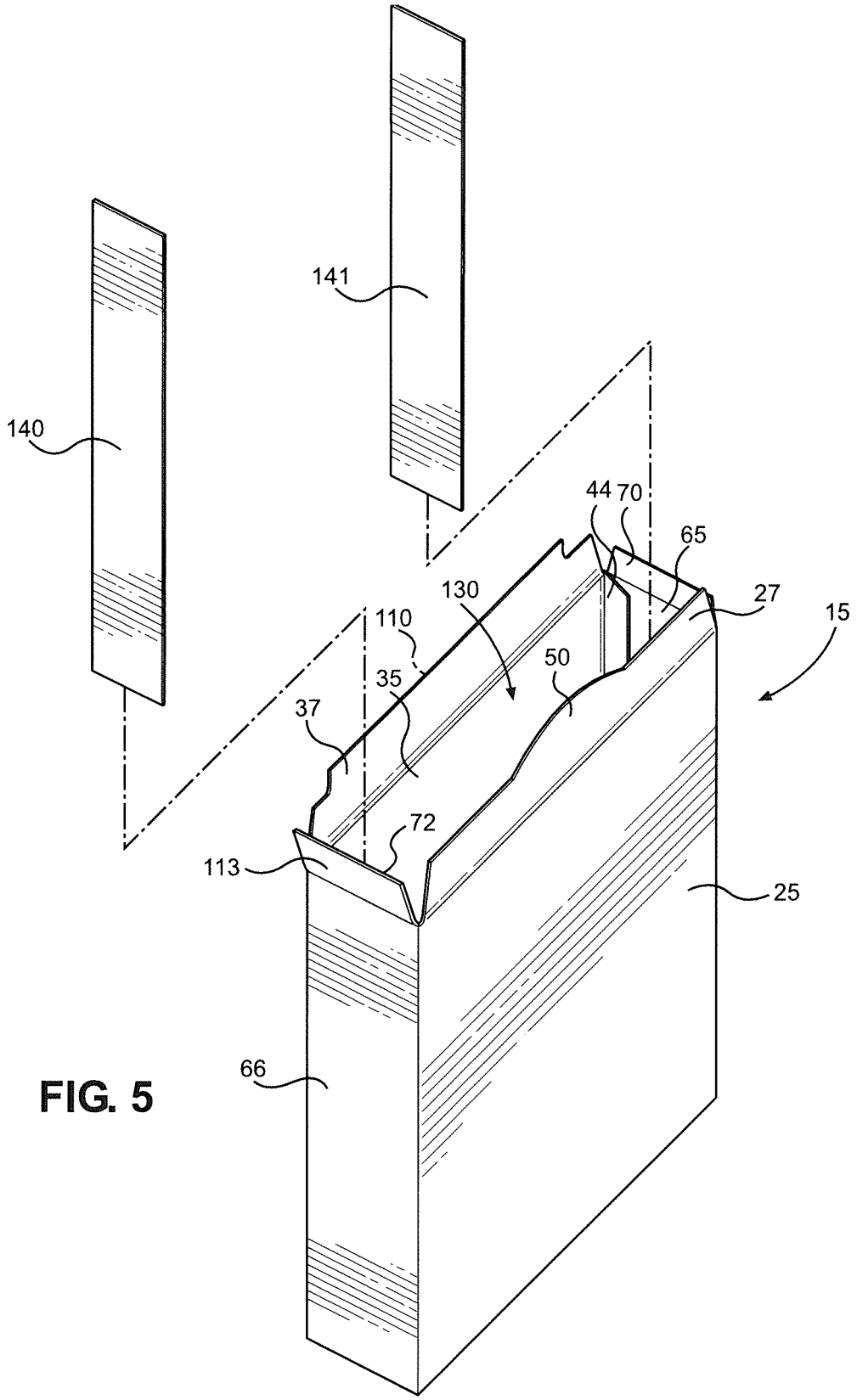
FIG. 5 is a perspective view, similar to FIG. 1, of a carton constructed in accordance with another embodiment.
Figure 6:
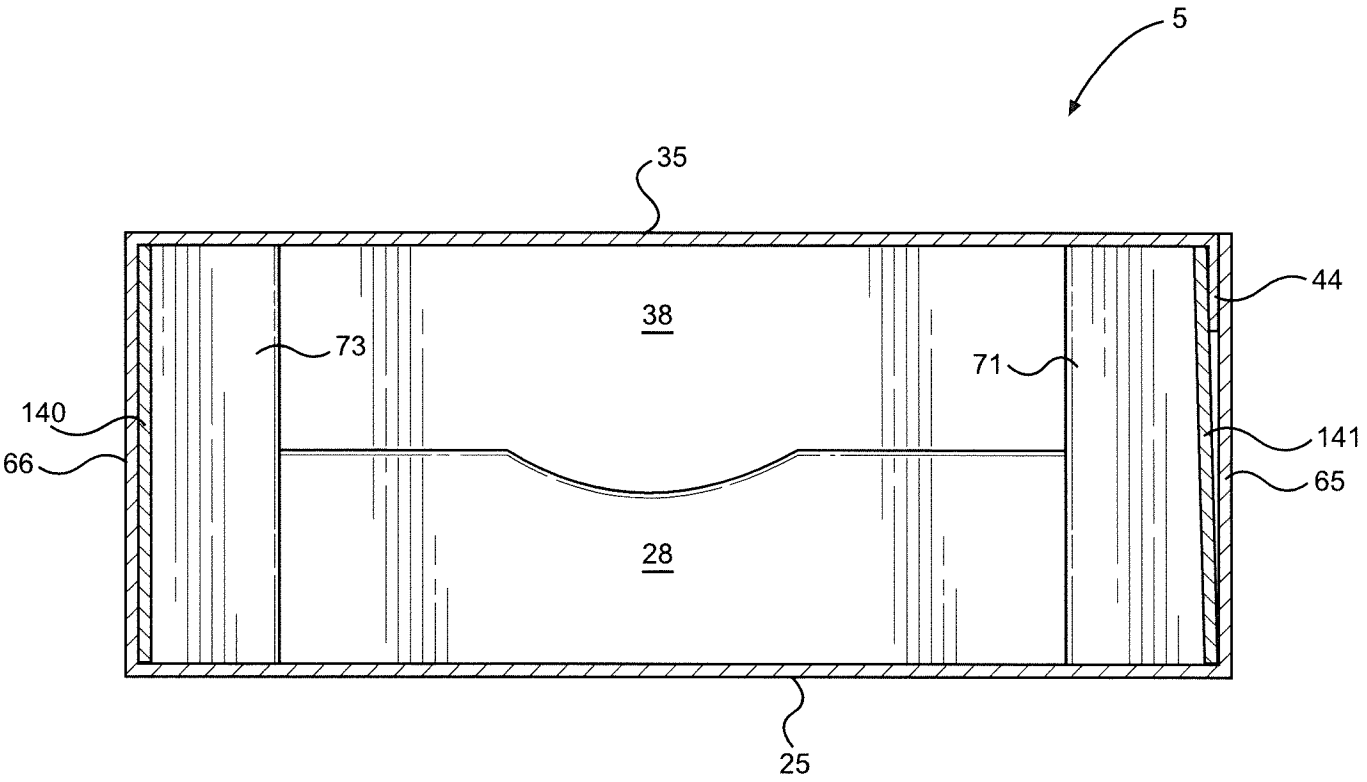
FIG. 6 is top cross-sectional view of the carton of FIG. 5.

At this point, it should be recognized that it is most important in accordance with the present invention to make the main body of carton 5 from a single blank to which is added side inserts. Although a preferred embodiment is described above, it should be recognized at this point that variations can be employed. For instance, FIGS. 5 and 6 show an alternative embodiment employing side inserts which only include side walls 140 and 141 which are secured to side panels 66 and 65 respectively. As clearly shown in FIG. 6 and corresponding to the embodiment described above, each of side walls 140 and 141 extends all the way to the vertical corners of carton 5, such as established along fold lines 42 and 81-83.

At this point it should be noted that, in connection with the invention, there is seen to exist particular advantages in employing the invention in connection with cartons having aspect ratios of bottom wall to either small side panel, i.e., side panel 40 or 41, which are less than one. That is, although the strength improvement achieved in accordance with the invention can be considered independent of aspect ratio, cartons or boxes including bottoms having associated areas greater than the relative side panels tend to be stronger and therefore may not benefit as much from the invention, at least as compared to cartons which have a relatively small base in combination with fairly large upstanding walls.

Figure 7:
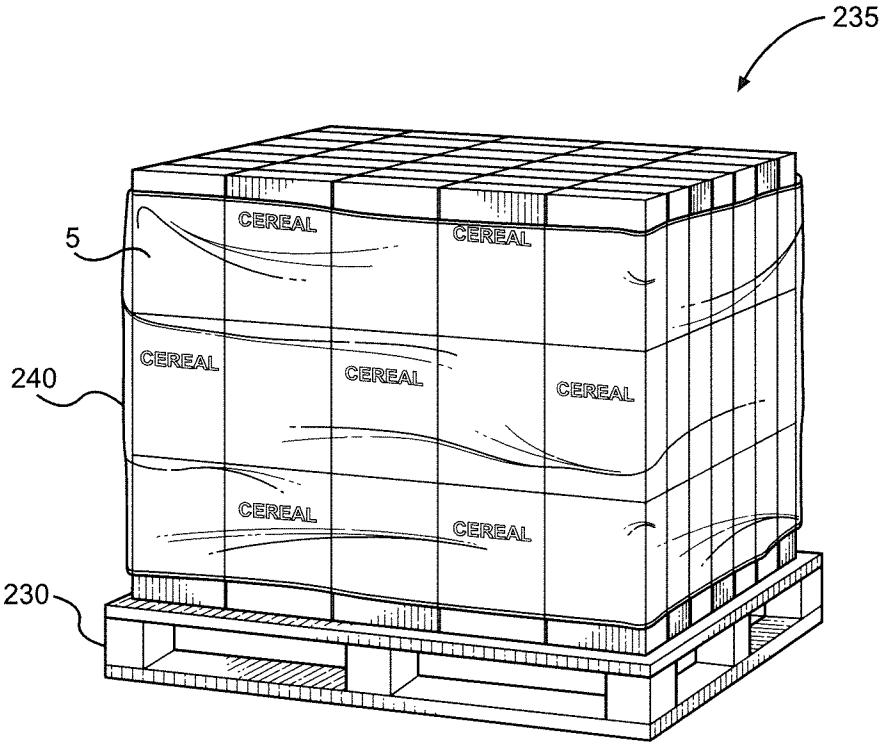
FIG. 7 is a perspective view of an array of the cartons of the invention assembled on a pallet for shipping.

As can be readily seen, the compression strengths associated with the cereal cartons constructed in accordance with the invention are significantly greater than the compression strength of a conventional cereal carton, even when the basis weight of the side inserts in accordance with the invention is the same as the blank. In fact, as evidenced above when comparing a fabricated, sealed one-piece 16 pt CRB caliper carton to a corresponding carton with 16 pt CRB unglued side inserts made in accordance with the invention, the top to bottom compression strength has been shown to increase by 76%, and the strength actually increased to over 150% (151% based on the above data) when the same side inserts were glued in place. By comparison, to achieve similar top to bottom compression values, it is estimated that a minimum of 5 pt and 10 pt caliper increases, respectively, would be required. Therefore, cartons of the invention can withstand increased vertical loading. Still, compression enhancements can also be achieved with fiber reductions for the blank and, correspondingly, savings in material costs. In either case, the increased compression strength has been amazingly found to avoid the need for additional corrugated shipping boxes. Instead, as represented in FIG. 7, it is possible to load a pallet 230 with an exposed array 235 of stacked cartons 5 constructed in accordance with the invention and employ shrink wrap 240, bands or the like to contain the directly exposed array 235 for shipping purposes. In addition, in practicing the invention it should be noted that known paper mill production techniques do not need to be altered to carry out the invention. That is, the components of the cartons of the invention can be made from standard paperboard stock, possibly while potentially reducing the fiber content of the paperboard blank such that the side inserts have a caliper which is actually greater than the caliper of the blank and the overall basis weight of the carton is reduced from a standard carton, yet still enhancing the compression strength.

Based on the above, it should be readily apparent that the invention provides for an end load carton with enhanced compression strength even with a reduction in basis weight. Although disclosed with reference to preferred embodiments of the invention, is should be readily apparent that various changes and modifications can be made to the invention without departing from the spirit thereof. For instance, assembly can be achieved utilizing means other than adhesive, such as ultrasonic welding. In addition, the timing of the attachment of the side inserts can be altered. For example, the side inserts could be attached to the blank prior to folding the blank. Furthermore, it should be recognized that different shapes can be employed for the inserts, such as I, T, H or the like shapes. Finally, the cartons can be employed to house various products, including additional food products like noodles. In any case, the invention is only intended to be limited by the scope of the following claims.

The invention claimed is:

1. A carton comprising:

a main body piece formed from a unitary blank having a first caliper, said unitary blank establishing a front panel, a rear panel, opposing side panels, a bottom wall and a top wall, with the front and rear panels, as well as the opposing side panels, being spaced by the bottom and top walls to provide the carton with an internal cavity adapted to contain at least one edible product to be sold to a consumer, wherein at least one of the opposing side panels is intermediate the front panel and the rear panel with associated fold lines directly therebetween; and at least two side inserts having a second caliper which is equal to or greater than the first caliper, each of said at least two side inserts being provided within the interior cavity and against a respective one of the opposing side walls, wherein the carton exhibits a compression strength which enables similarly configured cartons to be directly stacked upon each other for shipping purposes.

2. The carton of claim 1, wherein the unitary blank has a predominate fiber orientation which is directionally different from each of the at least two side inserts.

3. The carton of claim 2, wherein the predominate fiber orientation in the unitary blank is horizontal and a predominate fiber orientation in each of the at least two inserts is vertical.

4. The carton of claim 1, wherein the carton constitutes a cereal carton.

5. The carton of claim 1, wherein the carton forms one of a plurality of similarly constructed cartons which are stacked in an exposed array on a pallet and wrapped together for shipping purposes.

6. The carton of claim 1, wherein each of the at least two side inserts includes a main side wall and opposing legs, said main side wall extending directly along a respective one of the opposing side panels and the opposing legs extending directly along the front and rear panels respectively.

7. The carton of claim 1, wherein each of the at least two side inserts only includes a main side wall extending directly along a respective one of the opposing side panels.

8. The carton of claim 1, wherein a material composition of each of said at least two side inserts is different than the main body piece.

9. The carton of claim 1, wherein the carton is formed of paperboard and exhibits a top to bottom compression strength with the at least two side inserts which is increased by at least 76% as compared to a carton formed from the main body piece but without the at least two side inserts.

10. The carton of claim 9, wherein the top to bottom compression strength is increased by over 150%.

11. A method of forming a carton comprising:

folding a unitary blank having a first caliper to establish a front panel, a rear panel, opposing side panels, a bottom wall and a top wall, with the front and rear panels, as well as the opposing side panels, being spaced by the bottom and top walls to provide the carton with an internal cavity, including folding the unitary blank along fold lines directly between at least one of the opposing side panels, which is intermediate the front panel and the rear panel, and the front and rear panels; and placing at least two side inserts, having a second caliper which is greater than the first caliper, within the interior cavity and against a respective one of the opposing side walls, wherein the carton exhibits a compression strength which enables similarly configured cartons to be directly stacked upon each other for shipping purposes.

12. The method of claim 11, further comprising: filling the interior cavity with cereal food pieces to be sold to a consumer.

13. The method of claim 11, further comprising: stacking a plurality of the cartons in an exposed array on a pallet and wrapping the plurality of cartons together for shipping purposes.

14. The method of claim 11, wherein the unitary blank has a predominate fiber orientation which is directionally different from each of the at least two side inserts.

15. The method of claim 14, wherein the predominate fiber orientation in the unitary blank is horizontal and a predominate fiber orientation in each of the at least two inserts is vertical.

16. The method of claim 11, wherein each of the at least two side inserts is formed with a main side wall and opposing legs, and wherein each said main side wall extends directly along a respective one of the opposing side panels, with the opposing legs extending directly along the front and rear panels respectively.

17. The method of claim 11, wherein each of the at least two side inserts only includes a main side wall extending directly along a respective one of the opposing side panels.

18. The method of claim 11, further comprising: forming the carton such that a material composition of each of said at least two side inserts is different than the main body piece.

19. The method of claim 11, further comprising:

forming the carton of paperboard; and increasing a top to bottom compression strength of the carton by at least 76% with the at least two side inserts as compared to a carton formed from the unitary blank but without the at least two side inserts.

20. The carton of claim 19, wherein the top to bottom compression strength is increased by over 150%.

21. The method of claim 11, further comprising: gluing the at least two side inserts in place.

* * * * *